United States Patent [19]

Brekosky et al.

[11] Patent Number: 4,749,373

[45] Date of Patent: Jun. 7, 1988

[54] CRIMP SNAP RETENTION SYSTEM

[75] Inventors: Lawrence J. Brekosky, Etters; Jack S. Kissoyan; Vijay Kumar, both of Harrisburg, all of Pa.

[73] Assignee: AMP Incorporated, Harrisburg, Pa.

[21] Appl. No.: 60,721

[22] Filed: Jun. 22, 1987

[51] Int. Cl.[4] ..... H01R 13/40

[52] U.S. Cl. ..... 439/595; 439/594

[58] Field of Search ..... 439/595, 594, 597–599, 439/603

[56] References Cited

U.S. PATENT DOCUMENTS

| | | | |
|---|---|---|---|
| 3,631,375 | 12/1971 | Bridle | 339/59 M |
| 3,727,172 | 4/1973 | Clark | 339/59 M |
| 3,747,047 | 7/1973 | Carter et al. | 339/42 |
| 3,938,874 | 2/1976 | Bourdon | 439/595 |
| 4,187,272 | 2/1980 | Bourdon et al. | 264/318 |
| 4,425,015 | 1/1984 | Rizzo | 439/83 |
| 4,443,048 | 4/1984 | Moist, Jr. | 339/63 M |
| 4,544,220 | 10/1985 | Aiello et al. | 439/594 |
| 4,585,294 | 4/1986 | Wolowicz et al. | 339/252 R |
| 4,684,187 | 8/1987 | Rudy, Jr. et al. | 439/600 |

FOREIGN PATENT DOCUMENTS

| | | | |
|---|---|---|---|
| 2137027 | 9/1984 | United Kingdom | 439/595 |

OTHER PUBLICATIONS

AMP Incorporated Catalog No. 79-546, Dec. 1984, p. 6, AMP Incorporated Drawing No. 205234.

*Primary Examiner*—Eugene F. Desmond
*Assistant Examiner*—Paula A. Austin
*Attorney, Agent, or Firm*—David L. Smith

[57] ABSTRACT

A connector assembly (10) having an all plastic retention system has a housing (16, 18) in which tines (40) extend from a surface (36) thereof axially along contact receiving passages (38, 58). Each split frustoconical tine (40) has two tine members (42, 44). A transverse rib (54) extends along a surface (36) of the housing between adjacent tine members (42, 44) of adjacent tines (40). Each tine member (42, 44) has a pair of vertical ribs (50) extending along the exterior surface thereof upward from the surface (36) of the housing and sharing a portion of its volume with the transverse rib (54). The vertical ribs (50) and transverse rib (54) promote flow of plastic into all regions of the mould during moulding and support a contact (52) upon insertion thereof. A contact (52) inserted from the rear face (34) causes tine members (42, 44) to move radially outward until a retention bead (72) passes through an orifice (48) then tine members (42, 44) return to an unbiased position and contact (52) is secured in the connector assembly (10) as retention bead (68) is positioned between an annular shoulder (74) and the ends (46) of tine members (42, 44).

18 Claims, 3 Drawing Sheets

CRIMP SNAP RETENTION SYSTEM

BACKGROUND OF THE INVENTION

This invention relates to retaining contacts in an electrical connector and in particular to an all plastic retention system such as may be used in an electrical connector assembly to retain contacts therein.

Prior art electrical connectors typically had cylindrical passageways into which metallic contact retention means were inserted. The metallic inserts have a pair of forwardly facing lances which extended axially therealong and radially inward. When a contact is inserted from the rear of the connector housing into a passageway containing an insert, the lances spread as the contact passes therebetween until a retention bead on the contact passes over the end of the lances and the lances snap radially inward behind the retention bead. A cap prevents the insert from being pushed out of the passageway in the direction of insertion. A stop shoulder on the surface of the passageway prevents the insert from being withdrawn in the opposite direction to insertion such as when a conductor connected to a terminal inserted in the passageway is subjected to strain.

An all plastic retention system has been developed for larger connectors made of a thermoplastic material but has been unsatisfactory for smaller connectors. The moulding of thermoplastic housings having moulded tines, particularly for small connectors, has encountered problems of voids. Voids occur when a mould does not completely fill with plastic resulting in an incomplete moulded housing that is not useful.

SUMMARY OF THE INVENTION

A connector assembly in accordance with the present invention overcomes the above-mentioned moulding problems and has an all plastic retention system in a housing in which tines extend from a surface thereof axially along contact receiving passages. Each tine is comprised of two truncated semiconical tine members extending around the periphery of a contact receiving passage. A transverse rib extends along the surface of the housing between adjacent truncated semiconical tine members of adjacent tines. Each truncated semiconical tine member has a pair of vertical ribs extending along the exterior surface thereof upward from the surface of the housing. Where a transverse rib intersects a truncated semiconical tine member, the vertical ribs extend upwardly along the exterior surface of a tine member and are contiguous with and share a portion of the volume of the transverse rib such that during moulding, plastic flows from the transverse rib into and along the vertical ribs thence into the tine members to fill the mould. The transverse and vertical ribs function to support the truncated semiconical tine members upon insertion of a contact and to retain the inserted contact in position.

DESCRIPTION OF THE PREFERRED EMBODIMENT

Figure 1:
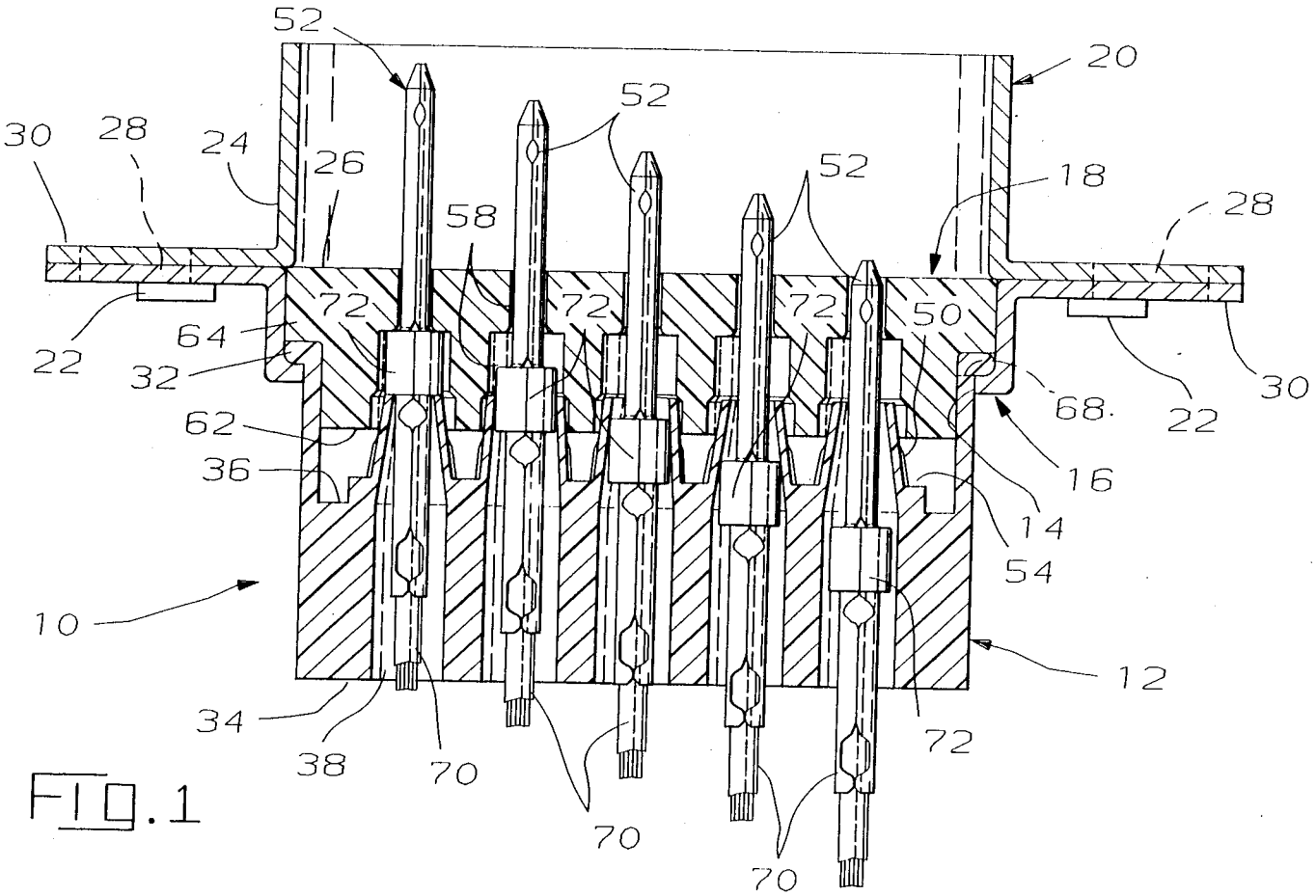
FIG. 1 is a cross section through a row of contacts at various stages of insertion of a connector assembly in accordance with the present invention.
Figure 2:
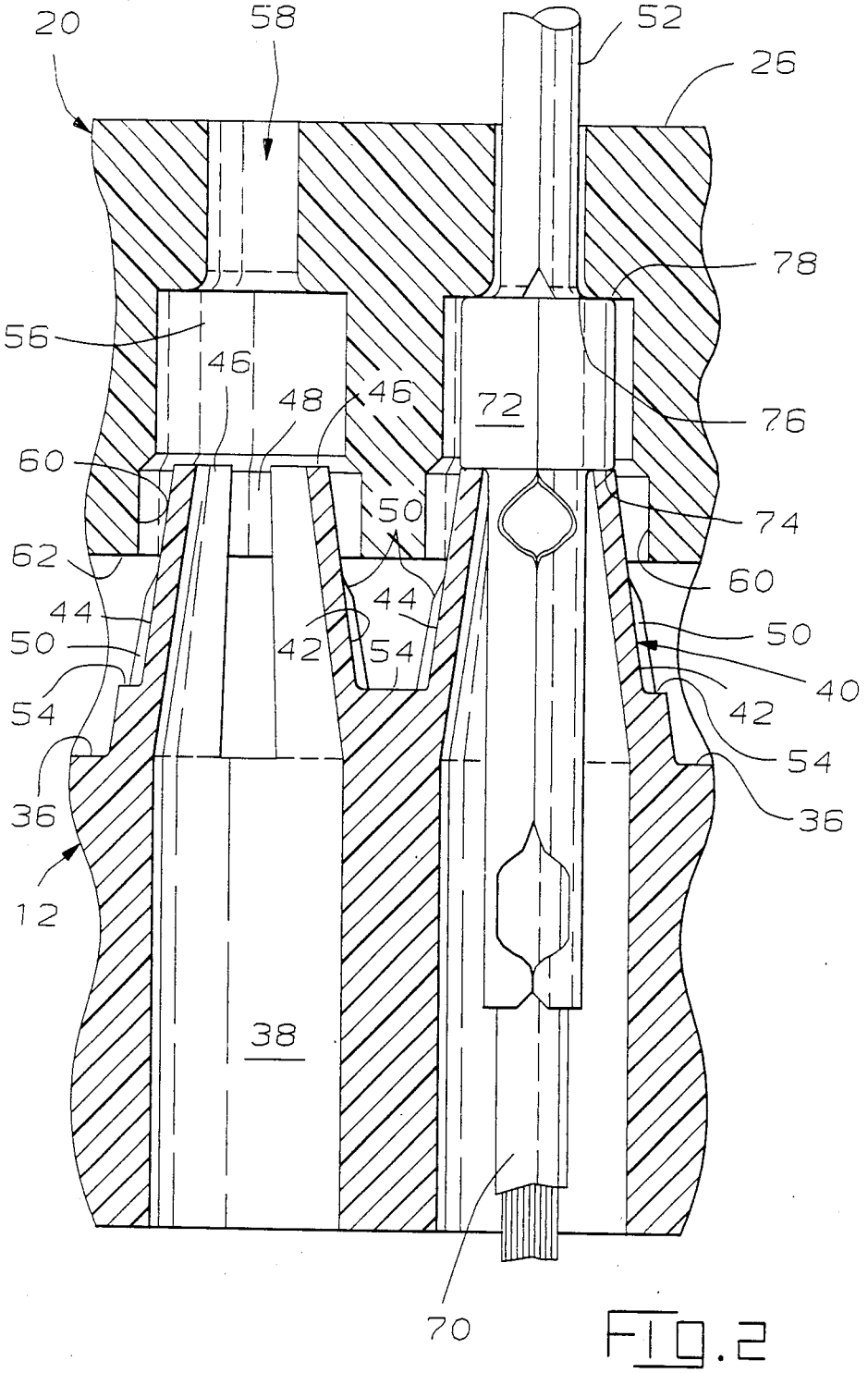
FIG. 2 is an enlarged partial cross-section of the connector assembly showing two adjacent contact receiving passages.
Figure 3:
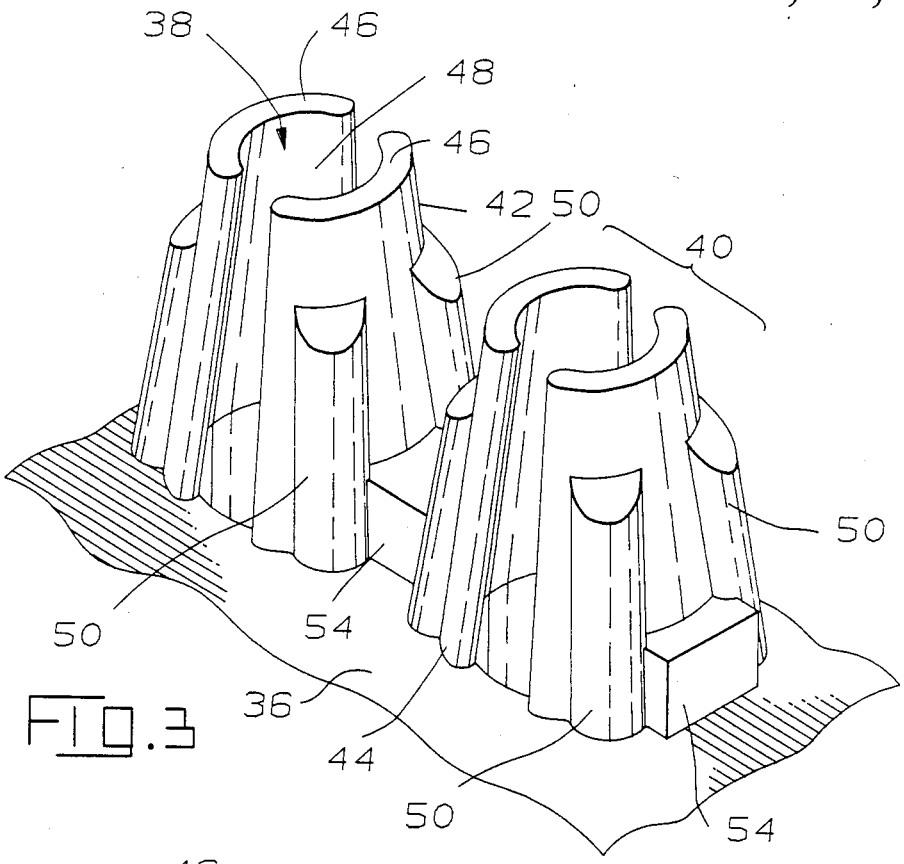
FIG. 3 is a partial perspective view of the rear insert showing a pair of adjacent tines and a vertical rib-transverse rib interface.

Referring to the drawing, initially to FIG. 1, connector assembly 10 is shown in cross section. In a preferred embodiment, assembly 10 comprises a thermoplastic rear insert 12 received in an aperture 14 in rear shell member 16. Thermoplastic forward insert 18 is received in rear shell member 16 and secured therein by forward shell member 20. Rear shell member 16 and forward shell member 20 are mechanically and electrically secured together by tabs 22 on forward shell member 20 folded over an edge of rear shell member 16.

Forward shell member 20 has a forwardly extending shroud 24 having the shape of a subminiature D connector. Shroud 24 surrounds mating face 26 to shield contacts within the shroud. Shroud 24 engages the shell of a complementary connector to electrically common shielding therebetween when connector assembly 10 is mated to a complementary shielded connector. Rear and forward shell members 16, 20 have aligned apertures forming mounting apertures 28 in integral flanges 30.

Although the connector assembly of the preferred embodiment is described with a forward and rear insert, these members could stand alone without a shield and comprise a connector assembly. The two members could be secured together in a known manner and have an integral mounting flange with a mounting aperture therein.

Rear insert 12 is secured in aperture 14 of rear shell member 16 by flange 32 extending around the periphery of aperture 14. Rear insert 12 has a rear face 34 and a forward face 36 with a plurality of contact receiving passages 38 extending therebetween. Extending forwardly from forward face 36 (upward in FIG. 1) are tines 40 having tyne members 42 and 44. Each tine 40 is a hollow split frustoconical structure substantially axially aligned with a contact receiving passage 38. Tines 40 are distributed circumferentially of respective contact receiving passages 38 and converge radially of respective passageways in the direction of insertion of a contact. Converging tine members 42 and 44 are resiliently deflectable and form at the end 46 thereof restricted orifices 48. Each tine 40 has, a vertical rib extending along the conical surface of each tine member 40, 42. In a preferred embodiment, each tine 40 has four vertical ribs 50 extending along the conical surface thereof, two along tine member 42 and two along tine member 44. Vertical ribs 50 provide lateral support for tine 40 during insertion of a contact 52 as well as subsequent to contact 52 insertion to retain contact 52 in position. Vertical ribs 50 further provide a path for plastic to flow into and fill the tine members during moulding of rear insert 12.

Transverse rib 54 is integral with a tine member 42 or 44 and extends along forward face 36. In a preferred embodiment, transverse rib 54 extends between tine member 42 of a first tine 40 and tine member 44 of an adjacent tine 40 in a row of tines, as well as beyond the end tine members 42, 44 of a tine 40 at the ends of a row of tines. Transverse rib 54 intersects vertical rib 50 and shares a common volume therewith. In the preferred embodiment in which each tine member has two vertical ribs extending along the conical surface thereof, transverse rib 54 intersects both vertical ribs and shares a respective common volume with each vertical rib 50. Transverse rib 54 does not extend forwardly of forward face 36 as far as vertical ribs 50, provides support for tine members 42, 44 and facilitates moulding rear insert 12 by providing a flow path for the plastic to fill vertical ribs 50 and tine members 42, 44. In a preferred embodiment, transverse rib 54 has a rectangular cross section, and is approximately one-third the height of vertical ribs 50 with the width of transverse rib 54 approximately one-half the diameter of the base of tine member 42, 44 at forward face 36. Thus, transverse rib 54 is wider than the thickness of the conical walls of a tine member 42, 44.

Tine members 42, 44 extend forwardly of forward face 36 into recesses 56 proximate contact receiving passages 58 in forward insert or cap 18. Recesses 56 may have a larger diameter section 60 in the region where tines 40 are received therein, at least in the direction of deflection of tine members 42, 44. Vertical ribs 50 do not extend along the surface of tine members 42,44 into recesses 56 so as not to interfere with cap 18 during deflection of tines 42, 44. In a preferred embodiment vertical ribs 50 extend along about 75 percent of the length of the surface of tines 42, 44.

Figure 4:
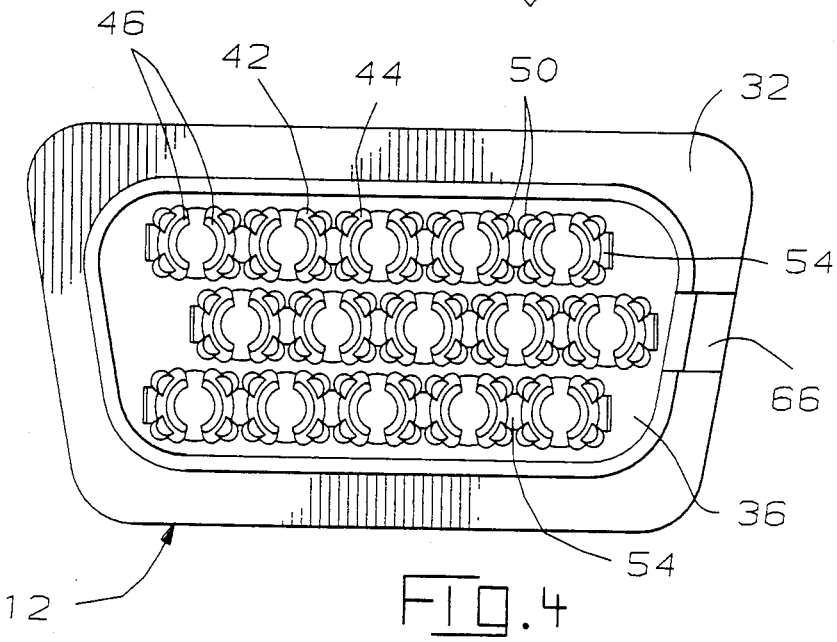
FIG. 4 is a top plan view of the rear insert.

Cap 18 has a corresponding number of contact receiving passages 58 extending therethrough between mating face 26 and rear face 62. Forward insert 18 is positioned relative to rear insert 12 by flanges 64 engaging flange 32 such that tine members 42, 44 extend into recesses 56. Recess 66 (see FIG. 4) in flange 32 and complementary protrusion 68 (see FIG. 1) in flange 64 provide a keying function to assure that rear insert 12 and forward insert 18 are properly assembled. The walls of recesses 56 provide an antioverstress function by limiting the deflection of tine members 42, 44.

A contact 52 having an insulated conductor 70 crimped thereto is inserted into axially aligned contact receiving passages 38 and 58 from rear face 34. The crimping of insulated conductor 70 to contact 52 is smaller in diameter than the outside diameter of retention bead 72. As retention bead 72 on contact 52 passes between tine members 42, 44, tine members 42, 44 deflect radially outward until annular rear shoulder 74 passes through orifice 48 and over ends 46, at which time tine members 42, 44 deflect radially inward to a substantially unbiased position. In this position, annular forward shoulder 76 on retention bead 72 abuts annular shoulder 78 in forward insert 18 while annular rear shoulder 74 abuts ends 46, but for tolerance stack-up.

Contact 52, shown in the preferred embodiment as a pin but could also be a socket, is secured in connector assembly 10 by retention bead 72 being positioned between annular shoulder 78 and the ends 46 of tine members 42 and 44. Contact 52 remains in connector assembly 10 when subjected to forward axial forces as annular forward shoulder 76 engages annular shoulder 78. Contact 52 remains in connector assembly 10 when subjected to rearward axial forces, such as during mating or stressing on insulated conductor 70, as annular rear shoulder 74 engages ends 46 of tine members 42, 44.

In accordance with known methods, a contact 52 can be removed from a contact receiving passage 38, 58 by insertion of a tool from rear face 34 to spread tine members 42, 44 of a tine 40 until annular rear shoulder 74 will pass through orifice 48.

We claim:

1. A connector assembly, comprising a first dielectric housing member for receiving terminals, said first housing member having a forward face, a terminal receiving face, terminal receiving passages extending therebetween, and frustoconical tines extending from the forward face, said tines axially aligned with respective terminal receiving passages and comprising resiliently deflectable tine members, each tine member having an integral transverse rib extending along the forward face and each tine member having a vertical rib extending along a conical surface thereof, said vertical rib sharing a portion of the volume of the transverse rib; and a second dielectric housing member, the second dielectric housing member for engaging the first dielectric housing member, for receiving terminals and for securing the terminals between the first and second dielectric housing members, said second dielectric housing member having terminal receiving passages corresponding in number and location to respective terminal receiving passages in said first dielectric housing, whereby terminals received in the terminal receiving passages are secured between the first and second dielectric housing members.

2. A connector assembly as recited in claim 1 wherein the transverse rib extends between adjacent tine members of adjacent tines.

3. A connector assembly as recited in claim 1 further comprising flange means having an aperture therein for receiving mounting means to secure the assembly to a complementary connector.

4. A connector assembly as recited in claim 1 wherein the terminal receiving passages in the first dielectric housing are in a row, the tines are in a row and the transverse rib extends between adjacent tine members of adjacent tines in the row of tines.

5. A connector assembly as recited in claim 1 further comprising terminals received in the terminal receiving passages of said first and second housing members.

6. A connector assembly as recited in claim 1 further comprising recesses in said second dielectric housing member proximate the terminal receiving passages adapted to receive a retention bead on said terminals.

7. A connector assembly as recited in claim 1 further comprising electrically conductive shell means surrounding a mating face for shielding the mating face and for engaging shield means of a complementary electrical connector.

8. A connector assembly as recited in claim 7 further comprising flange means having an aperture therein for receiving mounting means to secure the assembly to a complementary connector.

9. A connector assembly as recited in claim 8 wherein the flange means is integral with the shell means.

10. A connector assembly, comprising a first dielectric housing member for receiving terminals, said first housing member having a forward face, a terminal receiving face, terminal receiving passageways extending therebetween, and frustoconical tines extending from the forward face, said tines axially aligned with respective terminal receiving passages and comprising resiliently deflectable tine members, each tine member having an integral transverse rib extending along the forward face, each tine member having a pair of vertical ribs extending along a conical surface thereof, said vertical ribs sharing a respective portion of the volume of the transverse rib; and a second dielectric housing member, the second dielectric housing member for engaging the first dielectric housing member, for receiving terminals and for securing the terminals between first and second dielectric housing members, said second dielectric housing member having terminal receiving passages corresponding in number and location to the terminal receiving passages in said first dielectric housing, whereby terminals received in the terminal receiving passages are secured between the first and second dielectric housing members.

11. A connector assembly as recited in claim 10 wherein the transverse rib extends between adjacent tine members of adjacent tines.

12. A connector assembly as recited in claim 10 further comprising flange means having an aperture therein for receiving mounting means to secure the assembly to a complementary connector.

13. A connector assembly as recited in claim 10 wherein the terminal receiving passages in the first dielectric housing are in a row, the tines are in a row and the transverse rib extends between adjacent tine members of adjacent tines in the row of tines.

14. A connector assembly as recited in claim 10 further comprising terminals received in the terminal receiving passages of said first and second housing members.

15. A connector assembly as recited in claim 10 further comprising recesses in said second dielectric housing member proximate the terminal receiving passages adapted to receive a retention bead on said terminals.

16. A connector assembly as recited in claim 10 further comprising electrically conductive shell means surrounding a mating face for shielding the mating face and for engaging shield means of a complementary electrical connector.

17. A connector assembly as recited in claim 16 further comprising flange means having an aperture therein for receiving mounting means to secure the assembly to a complementary connector.

18. A connector assembly as recited in claim 17 wherein the flange means is integral with the shell means.

* * * * *